US007934845B2

(12) United States Patent
Yang

(10) Patent No.: US 7,934,845 B2
(45) Date of Patent: May 3, 2011

(54) CANDLE LIKE LIGHTING DEVICE

(76) Inventor: Chin-Sheng Yang, Tainan (TW)

( * ) Notice: Subject to any disclaimer, the term of this patent is extended or adjusted under 35 U.S.C. 154(b) by 112 days.

(21) Appl. No.: 12/244,782

(22) Filed: Oct. 3, 2008

(65) Prior Publication Data

US 2010/0085737 A1 Apr. 8, 2010

(51) Int. Cl.
*F21V 33/00* (2006.01)

(52) U.S. Cl. ..... 362/101; 362/161; 362/392; 362/569

(58) Field of Classification Search ..... 362/161, 362/569, 392, 101
See application file for complete search history.

(56) References Cited

U.S. PATENT DOCUMENTS 4,271,458 A * 6/1981 George, Jr. ..... 362/236
5,803,580 A * 9/1998 Tseng ..... 362/96
6,234,652 B1 * 5/2001 Tang ..... 362/392
6,241,359 B1 * 6/2001 Lin ..... 362/96
6,467,926 B1 * 10/2002 Tee et al. ..... 362/101
6,955,440 B2 * 10/2005 Niskanen ..... 362/96
2002/0089846 A1 * 7/2002 Shu ..... 362/118
2003/0202340 A1 * 10/2003 Wu ..... 362/101
2004/0257806 A1 * 12/2004 Wu ..... 362/242
2005/0036299 A1 * 2/2005 Tsai ..... 362/96
2006/0215397 A1 * 9/2006 Lee ..... 362/161
2009/0103285 A1 * 4/2009 Yang ..... 362/101
2009/0135586 A1 * 5/2009 Yang ..... 362/101

* cited by examiner

*Primary Examiner* — Evan Dzierznski
(74) *Attorney, Agent, or Firm* — Leong C. Lei

(57) ABSTRACT

A candle-like lighting device is disclosed. The device comprises a decorative seat and a base seat, characterized in that the decorative seat is a transparent configuration, and within the decorative seat a cavity is provided which could hold at least a kind of low boiling point liquid, and the center of the decorative seat is a through hole passing through the decorative seat, and a top cover is provided to the through hole which mounted with a glowing member, and the base seat is mounted with a circuit with light source components, and the circuit is provided with a heat-generating body allowing current to pass through to generate an impedance effect, and the circuit also provides the glowing component of the decorative seat to be connected by a conductive cable to generate light.

1 Claim, 4 Drawing Sheets

CANDLE LIKE LIGHTING DEVICE

TECHNICAL FIELD OF THE INVENTION

The present invention relates to candle-like lighting device, and in particular, a lighting device having a cavity containing a low boiling point liquid.

DESCRIPTION OF THE PRIOR ART

FIG. 4 shows a conventional candle-like lighting device comprising a transparent container 3 and a bottom seat 4, wherein the transparent container 3 holds a low boiling point liquid B, and the bottom seat 4 is mounted with halogen lamp module 41, which is correspondingly mounted to the base section of the transparent container 3. The base seat with external current supply causes the halogen lamp module 41 to produce light and heat energy to cause the low boiling point liquid B to flow and to reflect light. Thus a decorative effect to the lighting device is obtained.

The light source and heat energy are obtained by the employing of halogen lamp module 41, and the heat energy causes the flow of the low boiling point liquid B. In this instance, the halogen lamp must be of a sufficient wattage otherwise, heat energy generated would be insufficient to cause the effect. If the wattage of the halogen is too large, the cost of electricity is high and the transparent container 3 may be damaged. Further, the light intensity of the light of the halogen lamp module 41 might not be sufficient to produce variable ornamental design to the decorative lighting device.

Accordingly, it is an object of the present invention to provide a candle-like lighting device, which overcomes the above drawbacks and provides a new decorative appearance to the lighting device.

SUMMARY OF THE INVENTION

According to a preferred embodiment of the present invention, there is shown the decorative seat is a transparent configuration, and within the decorative seat a cavity is provided which could hold at least a kind of low boiling point liquid, and the center of the decorative seat is a through hole passing through the decorative seat, and a top cover is provided to the through hole which mounted with a glowing member, and the base seat is mounted with a circuit with light source components, and the circuit is provided with a heat-generating body allowing current to pass through to generate an impedance effect, and the circuit also provides the glowing component of the decorative seat to be connected by a conductive cable to generate light.

Yet an object of the present invention is to provide a candle-like lighting device, wherein the low boiling point liquid is added with a glowing plate.

Still another object of the present invention is to provide a candle-like lighting device, wherein the low boiling point liquid is added with glowing powder.

A further object of the present invention is to provide a candle-like lighting device, wherein the light source component of the circuit is a LED.

Other objects, and advantages will become more apparent in view of the following detailed description in conjunction with the accompanying drawings.

DETAILED DESCRIPTION OF THE PREFERRED EMBODIMENTS

The following will describe in detail the preferable embodiment of the present invention with a reference to the drawings.

Figure 1:
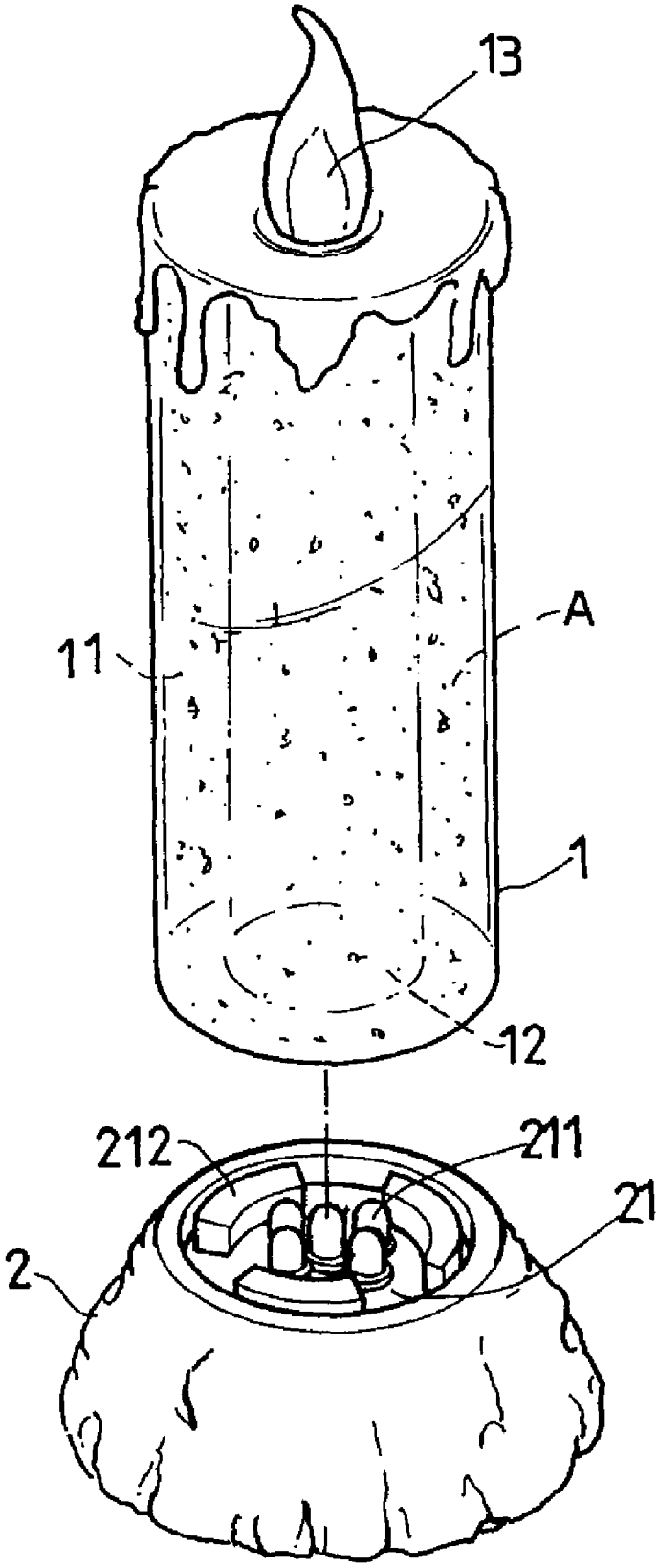
FIG. 1 is a perspective exploded view of a candle-like lighting device in accordance with the present invention.
Figure 2:
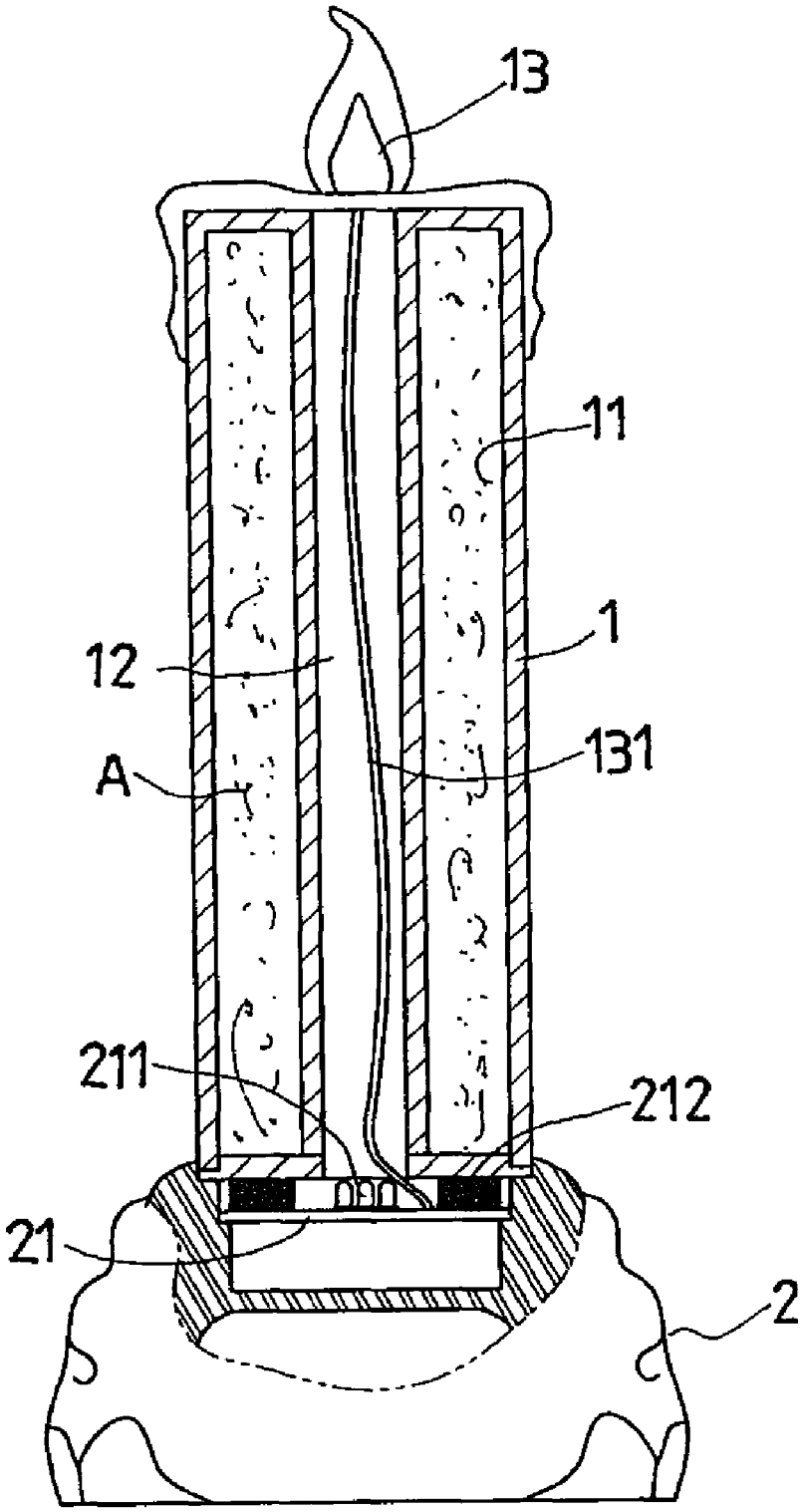
FIG. 2 is a sectional view of a candle-like lighting device in accordance with the present invention.

Referring to FIGS. 1 and 2, there is shown a candle-like lighting device in perspective and sectional views, comprising a decorative seat 1 and a base seat 2. In accordance with the preferred embodiment, the decorative seat 1 has a transparent configuration, and the interior of the decorative seat 1 has a cavity containing at least one low boiling point liquid A (for instance, CH2Cl2, and the low boiling point liquid A can be added with glowing plates or glowing powder. Further, the center of the decorative seat 1 has a longitudinal through hole 12 passing through the decorative seat 1 and the through hole 12 is provided with a top cap mounted with a glowing member 13.

The base seat 2 is correspondingly mounted below the decorative seat 1, and the interior of the base seat 2 is provided with a circuit structure 21 with light source component 211. The circuit structure 21 is provided with a heat generating body 212 which allows current to pass through to generate an impedance effect. The heat generating body 212 is common resistance, cement resistance, electric heating wire or electric heating plate which allow current to pass through so as to generate heat. In addition, the circuit structure 21 is provided to the glowing member 13 on the decorative seat 1 which is linked by conductive wire 131 to generate light.

Figure 3:
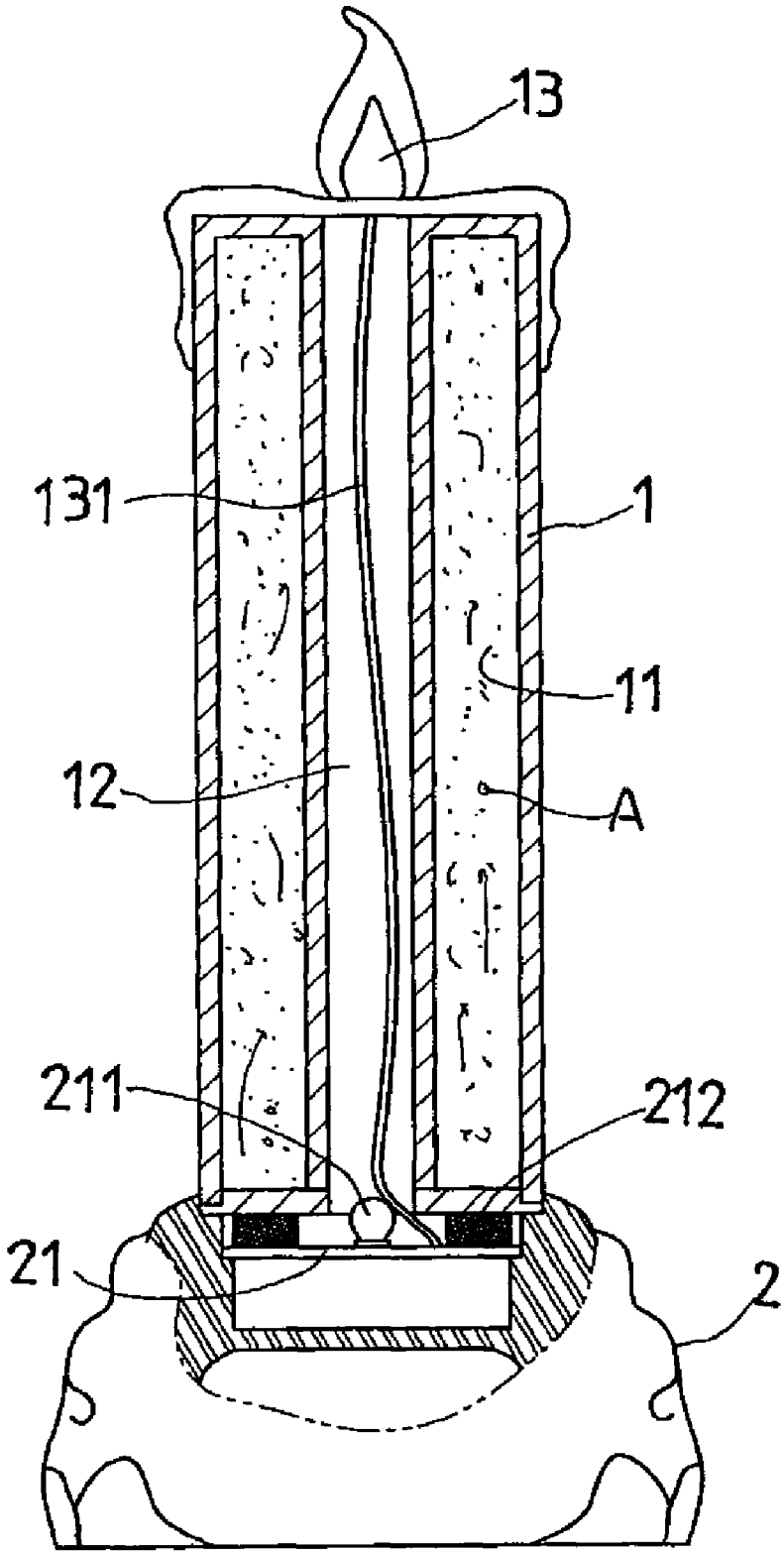
FIG. 3 is another sectional view of a candle-like lighting device in accordance with the present invention.
Figure 4:
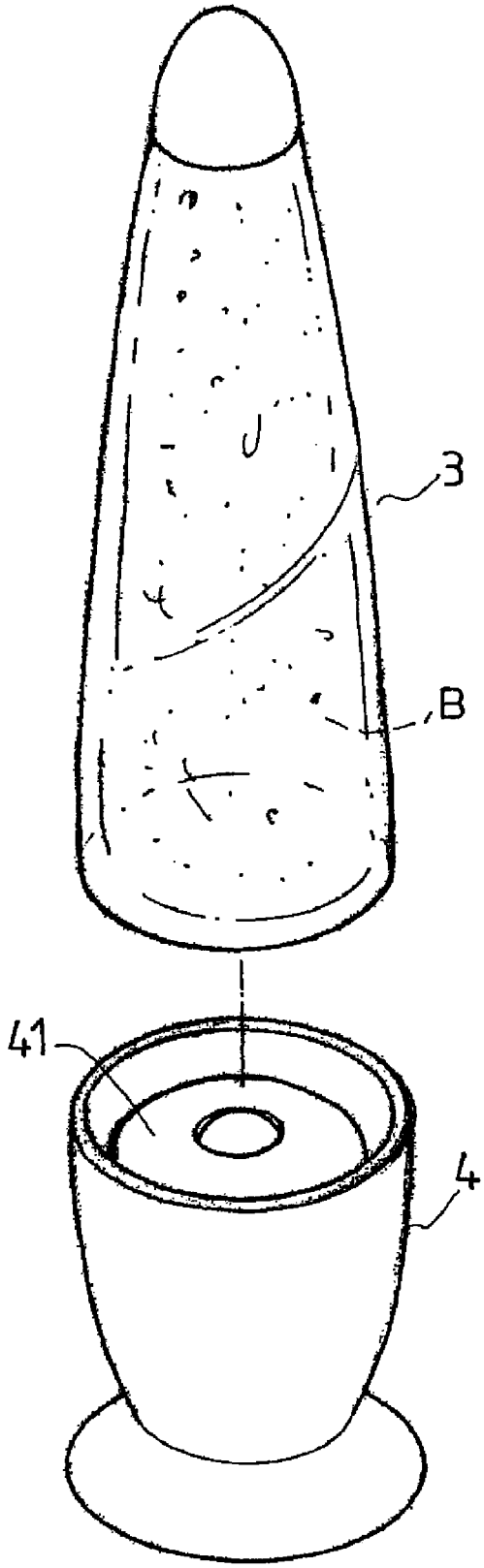
FIG. 4 PRIOR ART
FIG. 4 is a perspective exploded view of a conventional candle-like lighting device.

Referring to FIGS. 2 to 3, the cavity 11 of the decorative seat 1 is filled with low boiling point liquid A (for instance CH2CL2) and one end (base section) of the cavity 11 is sealed by low periodic wave method. The through hole 12 of the decorative seat 1 is correspondingly mounted with a glowing member 13 and is connected with a conductive wire 131 passing through the through hole 12. After that, the base seat 2 is mounted with circuit structure 21, and the circuit structure 21 is mounted with a light source element 211 (can be halogen bulb or LED as light source component) and a heat generating body 212, and the conductive wire 131 is correspondingly connected to the circuit structure 21. Thus, the decorative seat 1 is mounted to the base seat 2, and the heat generating body 21 of the base seat is close to the bottom face of the decorative seat 1.

When current is supplied to the circuit structure 21, the heat generating body 212 produces heat and the light from the light source component 211 will shine onto the low boiling point liquid A within the cavity 11 such that the low boiling point liquid A flows by means of the heat from the heat generating body 212, and thus a colourful candle-like decorative lighting device is obtained. The circuit structure 21 of the base seat 2 supplies current source via the conductive wire 131 such that the glowing component 13 on the low boiling point liquid A produces colourful light.

In accordance with the present invention, the candle-like lighting device possesses the advantages as follows:

(1) The light source component produces light and the heat-generating body producers heat source to the low boiling point liquid. The combination of material of the present invention provides a colourful decorative lighting structure and the use of current is at minimum.

(2) The through hole guides light into the decorative seat, and a glowing component at the top of the through hole provides light. Thus, when the through hole is not limited at one area, the exterior of the decorative seat can give several types of variations.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A candle-like lighting device comprising:

a base seat having a top provided with a circuit structure, said circuit structure being provided with a heat generating body and a light source component, said heat generating body allowing current to pass through to generate heat;

a decorative seat having a transparent configuration, said decorative seat having a cavity containing at least one low boiling point liquid provided with glowing powder, a center of said decorative seat having a longitudinal through hole;

a cap mounted on a top of said decorative seat and provided with a glowing member; and a conductive wire passing through said longitudinal through hole of said decorative seat to connect said circuit structure to said glowing member;

wherein when current is supplied to said circuit structure, said heat generating body will produce heat, said light source component will produce light, said glowing member will give light, and said low boiling point liquid will flow, thereby causing said decorative seat to produce colorful light.

* * * * *